United States Patent [19]

Bailey et al.

[11] Patent Number: 4,848,017

[45] Date of Patent: Jul. 18, 1989

[54] ILLUMINATED BUILDING NUMBER ASSEMBLY

[76] Inventors: James M. Bailey, 925 Albert St., Norfolk, Va. 23513; Walter M. Kindred, 1032 Anderson Way, Virginia Beach, Va. 23464

[21] Appl. No.: 82,613

[22] Filed: Aug. 7, 1987

[51] Int. Cl.[4] ..... G09F 13/04

[52] U.S. Cl. ..... 40/576; 40/564

[58] Field of Search ..... 40/575, 576, 541, 564

[56] References Cited

U.S. PATENT DOCUMENTS

| | | | |
|---|---|---|---|
| 1,505,625 | 8/1924 | Dearth . | |
| 1,518,708 | 12/1924 | Smith | 40/576 |
| 1,586,361 | 5/1926 | Gaffney | 40/565 |
| 1,657,967 | 1/1928 | Kichline . | |
| 1,709,202 | 4/1929 | Beldin . | |
| 1,747,400 | 2/1930 | Stewart et al. | 40/576 |
| 1,861,920 | 6/1932 | Holman | 40/576 |
| 2,225,961 | 12/1940 | Rundberg | 40/132 |
| 2,511,411 | 6/1950 | Mitchell | 40/132 |
| 2,601,733 | 7/1952 | Durey | 40/86 |
| 2,925,676 | 2/1960 | Yetman | 40/576 |
| 3,188,761 | 6/1965 | Harrold | 40/576 |
| 3,416,251 | 12/1968 | Bordner | 40/564 |

*Primary Examiner*—John J. Wilson
*Assistant Examiner*—Cary E. Stone
*Attorney, Agent, or Firm*—Griffin, Branigan & Butler

[57] ABSTRACT

An illuminated building number assembly (10) includes a one-piece box-like housing (12) constructed of hard molded opaque resinous plastic material and a separate one-piece front panel (14) of molded hard resinous opaque plastic. The front panel covers a housing opening (32) and includes vertical tracks (38*a–e*) with stops (46) at the bottom ends thereof on each side of the housing opening which allow the insertion of translucent number plates (16) from the tops thereof. A fluorescent light bulb (18) is mounted in the housing along with energizing equipment. When the front panel is mounted at the opening of the housing, the vertical tracks extend into the housing so that the number plates are prevented from moving upwardly by a top wall of the housing. Removable hard plastic mounting strips (20) are attachable at a rear wall (28) of the housing for allowing the housing to be attached externally on a building wall. The assembly can have a light sensor (68) in a separate light-sensor housing compartment to turn the fluorescent light bulb off in daytime and on at night.

6 Claims, 1 Drawing Sheet

ILLUMINATED BUILDING NUMBER ASSEMBLY

BACKGROUND OF THE INVENTION

This invention relates generally to the art of building number display devices, and more particularly to illuminated building-number displays.

Over the years a number of illuminated building-number assemblies have been suggested including those disclosed in U.S. Pat. No. 1,505,625 to Dearth, U.S. Pat. No. 1,657,967 to Kichline, U.S. Pat. No. 1,709,202 to Bedlin, U.S. Pat. No. 1,861,920 to Holman, U.S. Pat. No. 2,225,961 to Rundberg, U.S. Pat. No. 2,511,411 to Mitchell, and U.S. Pat. No. 2,601,733 to Durey. However, all of these systems are complicated to construct in that they require multiple diverse manufacturing steps, parts and materials. It is an object of this invention to provide a building number illumination assembly whose major components are manufactured in the same manner and whose electrical components are off-the-shelf items.

Another difficulty with most of prior art illuminated building-number assemblies is that they are relatively complicated to use, sometimes requiring a great deal of finger dexterity and knowledge to replace and/or change numbers and bulbs thereof. It is an object of this invention to provide a building number illumination device which is uncomplicated in use so that one inexperienced with tools can easily change and/or replace the numbers and bulbs thereof.

Another difficulty with most building-number illumination assemblies is that they having housings enclosing incandescent bulbs so that light can be directed at translucent number plates thereof. The incandescent bulbs and housings become extremely hot. This heat tends to prematurely "burn out" the incandescent bulbs and sometimes causes a hazard by making the housing rather dangerous to the touch. Also, it has usually been necessary to use particularly expensive construction to form the housings of the prior-art building number illumination devices so that they could withstand prolonged heat. It is an object of this invention to provide a building-number illumination device whose bulb has a particularly long life, which is not a safety hazard, and which can be made of inexpensive, easy-to-form, molded, material.

SUMMARY

According to principles of this invention, a box-like housing is molded of hard, opaque, resinous plastic material to have a front housing opening and a one-piece, separate, front panel of molded hard opaque resinous plastic, defining side-by-side panel openings therein. Vertical, parallel, panel tracks are molded on each side of each of the panel openings having stops at their bottom ends. These panel tracks allow the insertion of translucent number plates from top ends thereof but the stops at the bottom ends of the tracks hold the number plates therein. A fluorescent bulb, along with fluorescent electrical energizing equipment is mounted in the housing. When the front panel is mounted at the housing opening, the tracks thereof extend into the housing so that the number plates are prevented from sliding out of the tracks by the inside surface of a top wall of the housing. Removable molded, hard-plastic, mounting strips are selectively mountable on a back wall of the housing so that the housing can either be mounted on the outside surface of a building wall with the mounting strips or inset in the building wall without the mounting strip. The assembly has a light sensor in a separate light-sensor housing compartment to turn the fluorescent light bulb off in daytime and on at night.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
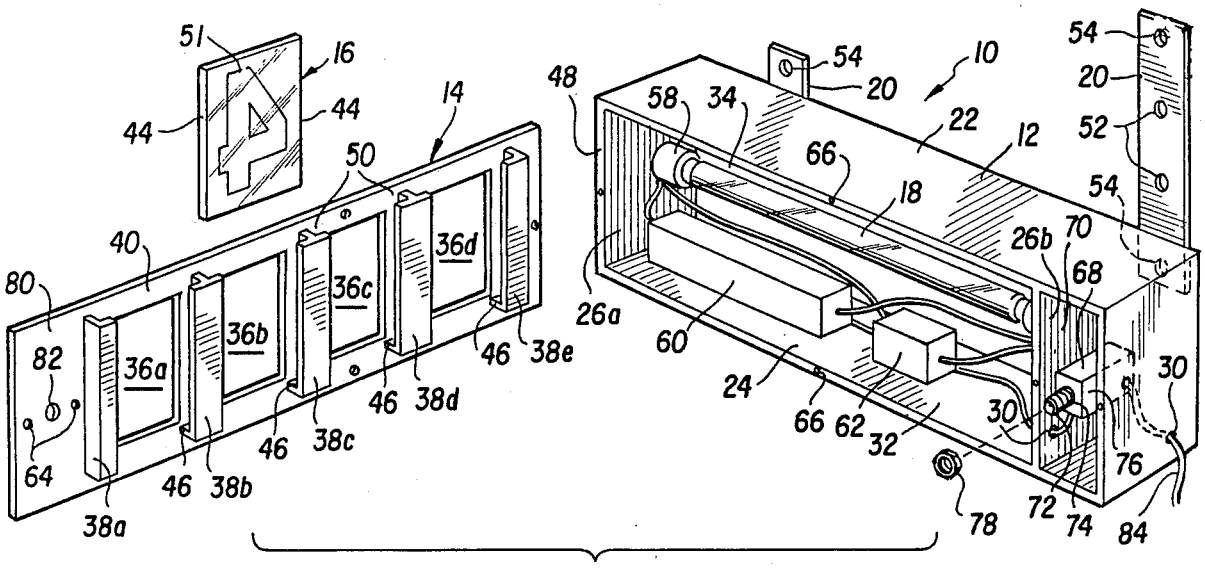
FIG. 1 is an exploded isometric view of a building-number illumination assembly of this invention.
Figure 2:
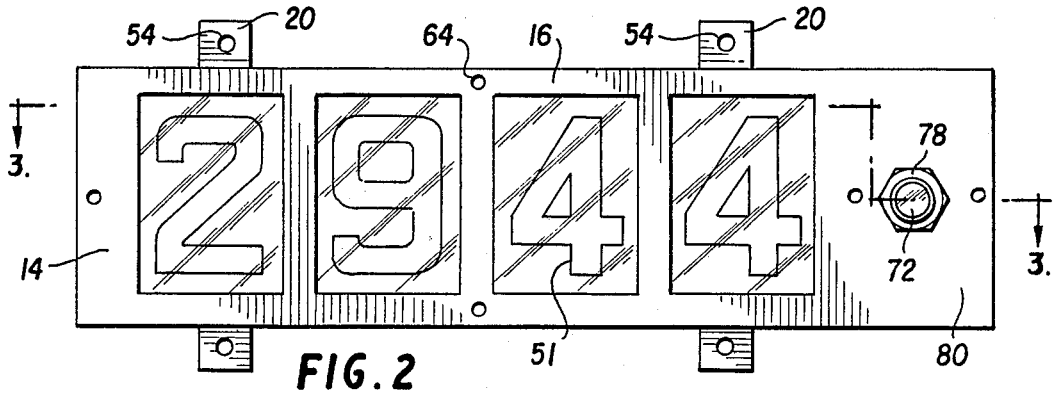
FIG. 2 is a front view of the building-number illumination assembly of FIG. 1 when it is put together with number plates and mounting strips.

A building number illumination assembly 10 comprise generally a housing 12, a front panel 14, a plurality of number plates 16, a fluorescent bulb 18 and associated fluorescent energizing equipment, and separate mounting strips 20.

The housing 12 is vacuum-formed molded of hard, acrylic, opaque, plastic, sometimes sold under the trademark PLEXIGLAS, to have a box shape with a top wall 22, a bottom wall 24, a left and right sidewalls 26*a* and 26*b*, and a rear wall 28. All of these walls are solid with the exception of a utility hole 30 in any one of the walls through which electric energy is brought into the housing 12 and a front housing opening 32. To improve the efficiency of the housing 12, the internal surface thereof is at least partially sprayed with a reflective paint 34.

Figure 3:
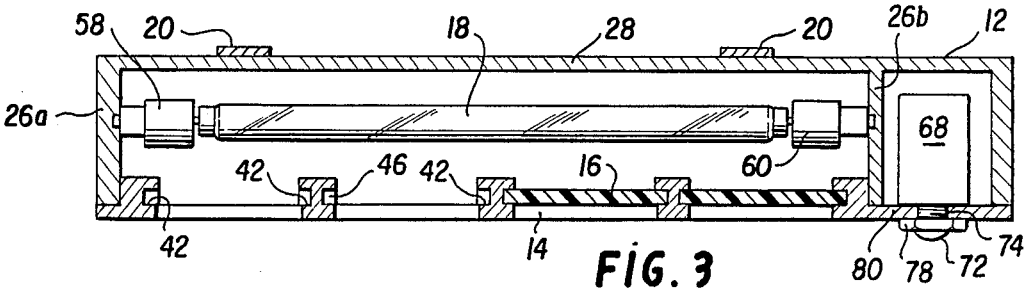
FIG. 3 is a simplified top sectional view taken on line 3—3 in FIG. 2.

The front panel 14 is also vacuum-formed molded as one separate piece of a hard, opaque, darkcolored acrylic plastic, sometimes sold under the trademark PLEXIGLAS. The front panel 14 has panel openings 36*a–d* therein and there are panel tracks 38*a–e* on opposite sides of each of the panel openings 36*a–d*. These tracks 38*a–e* are vacuum-formed molded integrally with a planar front plate 40. The end tracks 38*a* and 38*e* are L-shaped in horizontal cross section as can be seen in FIG. 3 and the intermediate tracks 38*b, c* and *d* are T-shaped in horizontal cross section. These tracks form vertical, parallel, U-shaped track slots 42 on each opposite side of the panel openings 32*a–d* for relatively loosely receiving and guiding opposite edges 44 of the number plates 16 and holding them in position in front of the panel openings 36*a–d*. In this respect, each of the vertical U-shaped slots 42 has at the bottom end thereof, molded as part of the front panel 14, a stop 46. The stops 46 prevent the number plates 16 from falling out of the slots 42 when the front panel 14 is held in a vertical position as is depicted in FIG. 1. It should be noted that the planer front plate 40 of the front panel 14 is sufficiently large to cover the front housing opening 32 and also to extend over the front edge 48. The tracks 38*a–e*, on the other hand, are somewhat smaller than the planar front plate 40 so as to leave a margin 50 at the edge of the planar front plate 40 which can extend over the front edge 48 of the housing 12 while the tracks 38*a–e* are inserted into the front housing opening 32. In this manner, when the front panel 14 is mounted on the housing 12 with number plates 16 therein, the number plates cannot slide in any direction because the tracks hold them at the sides and downwardly and they are prevented from moving upwardly by the inside surface of the top housing wall 22.

The number plates 16 are formed of translucent, light-colored, sheet acrylic which can be bought off-the-shelf and has opaque numbers 51 painted thereon.

Figure 5:
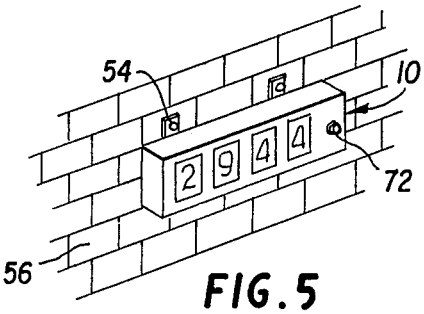

The separate mounting strips 20 are also constructed of hard, acrylic, plastic and have housing mounting holes 52 therein through which screws can extend for screwing the mounting strips 20 to the rear wall 28 of the housing 12. Also, there are building wall mounting holes 54 near opposite ends of the mounting strips 20 through which screws can extend for mounting the building-number illumination assembly 10 to a building wall 56 as is shown in FIG. 5.

The fluorescent bulb 18 is mounted at its opposite ends in sockets 58 and 60 which, in turn, are mounted to the walls of the housing 12. The sockets 58 and 60 are supplied with electrical energy in the normal manner with a ballast 60 and a starter 62, both of which may be mounted to the walls of the housing 12 with appropriate screws (not shown).

In the depicted embodiment is also included a light sensor 68 in a separate light-sensor compartment 70 of the housing 12. the light sensor 68 has an "eye" or light-sensing element 72 mounted on a threaded shaft 74 which protrudes from a light-sensor housing 76. The threaded shaft 74 meshes with a nut 78 which can be used for mounting the light sensor 68 on a light-sensor extension 80 of the front panel 14. In this regard, the threaded shaft 74 extends through an opening 82 in the cover light-sensor extension 80 and the nut 78 engages the threaded shaft 74 to clamp the cover light-sensor extension 80 between it and the light-sensor housing 76. A power cord 84 extends through a utility hole 30 into the light-sensor housing compartment 70, is connected in series with the light sensor 68, extends through another utility hole 30 and is connected to the ballast 60 and a socket 58. The light sensor 68 will only allow power to energize the bulb 18 if the sensing element 72 senses a sufficient level of light outside the housing 12.

Figure 4:
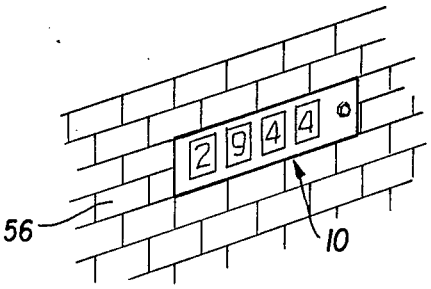
FIG. 4 is an isometric view of the front of a brick building wall showing the building-number illumination device of FIGS. 1–3 inset therein; and, FIG. 5 is a isometric view of the buildingnumber illumination assembly of FIGS. 1–3 shown mounted on the outside surface of a brick building wall.

In use, the housing 12 can be mounted in an inset manner as shown in FIG. 4 with the mounting strips 20 removed. In this regard, the height of the housing is approximately the same as that of two bricks so that two rows of bricks can be left out to form an opening in which the housing 12 is inset. If, however, it is desirable to mount the housing 12 on the outside of a building wall, as is shown in FIG. 5, the mounting strips 20 are attached to the rear wall 28 of the housing 12 with screws through holes 52 and screws are then extended through the building-wall mounting holes 54 of the mounting strips 20 to hold the assembly on a building wall.

Thereafter, the front panel 14 is removed by removing screws extending through holes 64 in the planar front plate 40 of the front panel 14 and screwing the nut 78 from the threaded shaft 74 of the light sensor 68. With the front panel 14 removed, number plates are slid from the top ends of tracks 38*a–e* into the U-shaped slots 42 so that a number plate covers each of the panel openings 36*a–d*. These numbers are prevented from falling out of the bottoms of the tracks by the stops 46. Also, while the front panel is removed, a fluorescent bulb 18 is mounted in the sockets 58 and 60. Thereafter, the front panel 14 is manipulated so that the tracks 38*a–d* are inserted into the front housing opening 32, the threaded shaft 74 passes through the opening 82, and the margin 50 of the planar front plate 40 is pressed against the front edge 48 of the housing 12. Screws are then extended through the panel screw holes 64 into housing screw holes 66 to mount the front panel 14 on the housing 12. In this position, the number plates 16 cannot move.

The light-colored number plates 16, in contrast the the dark-colored front panel 14, make the numerals 51 clearly visible in daytime when the light sensor 68 maintains the fluorescent bulb 18 "off". However, at night time, when it gets dark, the light sensor 68 turns the bulb 18 on to make the numbers 51 more visible. The separate light-sensor housing compartment 70 protects the light sensor 68 from being affected by light from the bulb 18.

It will be understood by those of ordinary skill in the art that fluorescent bulbs operate at a much lower temperature than normal light bulbs, with more of the electric energy going into emitting light and less into heat. Also, fluorescent bulbs are relatively efficient if they are not turned off and on. The relative lower temperature of the fluorescent bulb 18 will not cause the housing 22 to become too hot and thereby become a safety hazard. Further, the resinous plastic housing is not damaged by the lower temperatures at which the fluorescent bulb 18 operates. Also, the fluorescent bulb 18 will last much longer than an incondescent bulb.

It will also be understood by those of ordinary skill in the art that the major components of this device are manufactured in the same manner, that is, by vacuum forming. Other components can be bought off-the-shelf. Thus, it is relatively easy to manufacture the building-number illumination assembly of this invention.

While the invention has been particularly shown and described with reference to a preferred embodiment, it will be understood by those skilled in the art that various changes in form and detail may be made therein without departing from the spirit and scope of the invention. For example, the number plates 16 can be made of glass rather than acrylic plastic.

The embodiments of the invention in which an exclusive property or privilege are claimed are defined as follows:

1. An illuminated building number assembly comprising:

a one-piece box-like housing molded of hard, opaque, resinous plastic material, said housing having a back wall, a top wall, a bottom wall, and a first and second sidewalls, but defining a front housing opening at the front side thereof;

a fluorescent light bulb mounted in said housing and electronic energy supply equipment in said housing for supplying electrical energy to said fluorescent bulb;

a one-piece, separate, front panel removably mounted on said housing, said front panel being of molded, hard, opaque, resinous, plastic, said front panel comprising a planar sheet defining a plurality of side-by-side pane openings therethrough separated by vertical dividers, said front panel having a front side to be facing away from said housing and a back side to be facing toward said housing, said front panel further including on said backside thereof, vertical parallel tracks defining vertical, parallel, U-shaped in-horizontal-cross-section, track slots, one adjacent each right and left side of each opening and a stop formed at the bottom end of each of said track slots, but the top ends thereof being open;

a plurality of flat translucent number plates, each having an opaque number printed thereon, said number plates being of a size such that opposite right and left edges of each of them will fit in respective track slots located on opposite sides of an opening;

attachment means for attaching said front panel at the front opening of said box;

whereby each track is adapted to receive a translucent number plate to cover each of said panel openings to be held therein by said bottom stops, said panel being then reattached at said front housing opening, and said fluorescent bulb being energized to provide light behind said number plates.

2. An illuminated building number assembly as in claim 1 wherein said planar front plate of said front panel includes a margin about said tracks so that said tracks can be inset into said housing opening with said margin of said planar front panel being positioned on a front edge of said housing surrounding said housing opening thereby preventing upward movement of the number plates out of said track slots.

3. An illuminated building number assembly as in claim 2 wherein each of said tracks extend substantially the entire vertical length of the number plates.

4. An illuminated building number assembly as in claim 2 wherein is further included removable mounting strips which can be selectively attached to said rear wall of said housing and extending laterally from said housing for attaching said housing to the outer surface of a building wall.

5. An illuminated building number assembly as in claim 1 wherein is further included removable mounting strips which can be selectively attached to said rear wall of said housing and extending laterally from said housing for attaching said housing to the outer surface of a building wall.

6. An illuminated building number assembly as in claim 1 wherein said housing has a separate compartment and wherein there is a light sensor positioned in said separate compartment, said light sensor receiving light from outside atmosphere and being electrically connected in series with said electronic energy supply equipment for allowing electrical energy to flow thereto when it is dark outside, but not allowing energy to flow thereto when it is light outside.

* * * * *

UNITED STATES PATENT AND TRADEMARK OFFICE

CERTIFICATE OF CORRECTION

PATENT NO. : 4,848,017

DATED : July 18, 1989

INVENTOR(S) : JAMES A. BAILEY and WALTER KINDRED

It is certified that error appears in the above-identified patent and that said Letters Patent is hereby corrected as shown below:

Title page:

In the Inventors names, change "James M. Bailey" to --James A. Bailey--.

Signed and Sealed this

Fifteenth Day of May, 1990

*Attest:*

HARRY F. MANBECK, JR.

*Attesting Officer*

*Commissioner of Patents and Trademarks*